US006496994B1

(12) United States Patent
Omel et al.

(10) Patent No.: US 6,496,994 B1
(45) Date of Patent: Dec. 24, 2002

(54) BACK SUPPORT

(76) Inventors: Richard Omel, 158 Queen Street East, St. Marys, Ontario (CA), N4X 1A4; Rory Omel, 158 Queen Street East, St. Marys, Ontario (CA), N4X 1A4

( * ) Notice: Subject to any disclaimer, the term of this patent is extended or adjusted under 35 U.S.C. 154(b) by 0 days.

(21) Appl. No.: 09/613,776

(22) Filed: Jul. 11, 2000

(51) Int. Cl.[7] ..... A47C 27/08; A47C 7/40
(52) U.S. Cl. ..... 5/655.3; 5/654; 297/284.6
(58) Field of Search ..... 5/652, 653, 654, 5/655.3, 657, 644, 639, 413 AM, 419, 485; 297/284.6, DIG. 3; 206/315.9; 446/226

(56) References Cited

U.S. PATENT DOCUMENTS

| | | | | | |
|---|---|---|---|---|---|
| 1,216,425 | A | * | 2/1917 | Eiseman | 446/226 |
| 1,864,648 | A | * | 6/1932 | Haines | 5/655.3 X |
| 2,045,784 | A | * | 6/1936 | Leve | 5/419 |
| 2,521,530 | A | * | 9/1950 | McGuffage | 5/630 |
| 2,822,554 | A | * | 2/1958 | Wenzelberger | 5/644 |
| 2,942,281 | A | * | 6/1960 | Cole | 5/644 |
| 3,312,987 | A | * | 4/1967 | Emery | 5/644 |
| 3,651,847 | A | * | 3/1972 | Casamassima | 5/644 X |
| 3,974,827 | A | * | 8/1976 | Bodeen | 606/237 |
| 4,108,492 | A | * | 8/1978 | Kirby | 297/284.6 |
| 4,231,125 | A | * | 11/1980 | Tittl | 5/485 X |
| 4,277,859 | A | * | 7/1981 | Seaman | 5/639 |
| 4,516,568 | A | | 5/1985 | Baxter et al. | |
| 4,533,050 | A | * | 8/1985 | Bake, Jr. | 206/545 |
| 4,754,512 | A | * | 7/1988 | Chao-Yang | 5/485 X |
| 4,759,543 | A | * | 7/1988 | Feldman | 297/284.6 |
| 4,981,131 | A | * | 1/1991 | Hazard | 297/DIG. 3 |
| 5,003,653 | A | * | 4/1991 | Mar | 5/654 |
| 5,054,854 | A | | 10/1991 | Pruit | |
| 5,085,320 | A | * | 2/1992 | Scott | 206/315.9 |
| 5,163,192 | A | * | 11/1992 | Watson | 5/419 |
| 5,173,979 | A | * | 12/1992 | Nennhaus | 5/644 X |
| 5,303,977 | A | * | 4/1994 | Sereboff | 297/284.6 X |
| 5,597,339 | A | * | 1/1997 | Spector | 446/226 |
| 5,711,575 | A | | 1/1998 | Hand et al. | |
| 5,735,776 | A | * | 4/1998 | Swezey et al. | 482/91 |
| 5,779,044 | A | * | 7/1998 | Myers, Jr. | 206/315.9 |
| 5,785,669 | A | | 7/1998 | Proctor et al. | |
| 5,992,623 | A | * | 11/1999 | Myers, Jr. | 206/315.9 |
| 6,047,425 | A | * | 4/2000 | Khazaal | 5/644 |
| 6,095,390 | A | * | 8/2000 | Bogle | 224/664 |
| 6,175,978 | B1 | * | 1/2001 | Nizzi et al. | 5/644 |

FOREIGN PATENT DOCUMENTS

| | | | | |
|---|---|---|---|---|
| CH | 665941 B | * | 6/1988 | 297/DIG. 3 |
| DE | 267348 | * | 12/1968 | 297/284.6 |
| DE | 3045386 | * | 7/1982 | 297/284.6 |
| GB | 398584 | * | 9/1933 | 5/419 |
| GB | 2047088 | * | 11/1980 | 297/284.6 |
| GB | 2194883 A | * | 3/1988 | 5/644 |
| GB | 2205236 A | * | 12/1988 | 5/655.3 |

* cited by examiner

*Primary Examiner*—Robert G. Santos
(74) *Attorney, Agent, or Firm*—Gifford, Krass, Groh, Sprinkle, Anderson & Citkowski, P.C.

(57) ABSTRACT

A sitting posture correction device for placement between a backrest and the back of a user. The device comprises an inflatable bladder which is generally spherical in shape when fully inflated and a flexible, substantially rectangular cover for the bladder forming a pocket and adapted to contain the bladder, when the latter is partially inflated, in the pocket. During use of the device, the bladder is located within the cover, is partially inflated, and is free to shift and change its shape within the cover.

19 Claims, 2 Drawing Sheets

BACK SUPPORT

BACKGROUND OF THE INVENTION

This invention relates to back support devices for supporting a person's back when he or she is seated.

Backrest cushions in many different forms are well known. Cushions in various shapes, sizes and constructions have been made available for spine comfort and support purposes. A number of devices have included foam chair inserts, and some have been inflatable. For example, inflation devices have been included in automotive seats, controlled by small air pumps which are manually operated by the driver.

In U.S. Patent No. 4,516,568 issued May 14, 1985 to K.C.A. Baxter et al., a pressure exerting device is taught. The device, which can be placed between a human back and a seat back, includes a resilient wedge-shaped member and a modified U-shaped bladder with compartments. The bladder expands the lower region of the device. A belt and an anchor are provided for securing the back support in place. A bladder cover secures the bladder to the wedge-shaped member.

Many back supports support the low back at the expense of compromising the normal curves of the middle back and the neck. These compromises place increased demand upon the middle back and neck muscles, which in turn places indirectly an increase of stress on the low back. An ideal back support should support the body so that it can maintain efficient relationships between the pelvis, spine and head. The back support must encourage the body to move and shift positions. It will stimulate the body to shift back to an optimal position when it falls away from an optimal one.

SUMMARY OF THE INVENTION

The present invention provides a device for back support purposes including an inflatable bladder which is generally spherical in shape when filly inflated. A pouch made of cloth material is adapted to contain the bladder when the bladder is only partially inflated. When the device is employed, the partially inflated bladder largely fills the pouch.

The present invention also provides a sitting posture correction device for placement between a backrest and the back of a user. The device comprises an inflatable bladder which is generally spherical in shape when fully inflated and a flexible substantially rectangular cover for the bladder forming a pocket and adapted to contain the bladder, when the latter is partially inflated, in the pocket. The cover has a closable opening for insertion or removal of the bladder. During use of the device, the opening is closed and the bladder is contained within the cover, is partially inflated, and is free to shift and change its shape within the cover.

Further features and advantages will become apparent from the following detailed description of a preferred embodiment taken in conjunction with the accompanying drawings.

DETAILED DESCRIPTION OF PREFERRED EMBODIMENT

Figure 1:
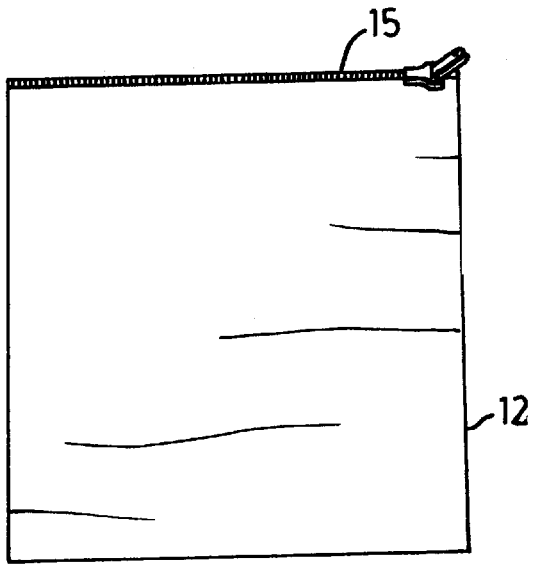
FIG. 1 illustrates a pouch used in the present invention.

FIG. 1 illustrates a preferred pouch or cover 12 for use in the present invention The pouch 12 is formed with two shoots of rectangular dimensioned material. The sheet material is preferably canvas textile, although the pouch call be made from other materials well known to those skilled in the art Preferably the top and bottom sides or edges of the pouch are 12" long, and the right and left sides or edges of the pouch are 13" long. These dimensions and the dimensions mentioned hereinafter can be smaller for a smaller than average person (e.g. a child). During the manufacturing process, the two sheets of textile material are attached together along the top and side edges by suitable stitching. It is also possible that one of the edges is formed by simply folding a rectangular piece of the material. Thus the cover 12 is substantially flat in an empty state.

A zipper 15 runs along the top side of the pouch. The zipper allows for the creation and closing of a large pouch opening as is evident in the drawings. A large opening is provided in the pouch because it is necessary to be able to insert and remove an air bladder as discussed below. Although a zipper is illustrated in FIG. 1, it will be appreciated that there are other ways for providing a pouch opening along one edge and means for closing same.

Figure 2:
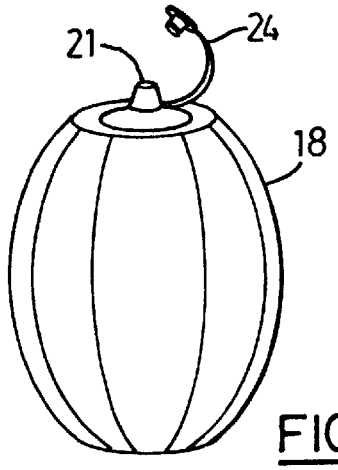
FIG. 2 (PRIOR ART)
FIG. 2 illustrates a non-inflated ball similar to a beach ball.

In use of the present invention, an inflatable bladder is placed in the pouch. One preferred form of inflatable bladder is a 16" diameter inflatable ball, which is commonly referred to as a "beach ball" and which is very inexpensive to manufacture. A deflated vinyl beach ball 18 is illustrated in FIG. 2. The ball 18 has an air valve 21 which can be sealed by an attached plug 24. The valve 21 allows the ball 18 to be blown up by means of, for example, a human blowing into it or by attaching a bicycle pump with a special adaptor.

Figure 3:
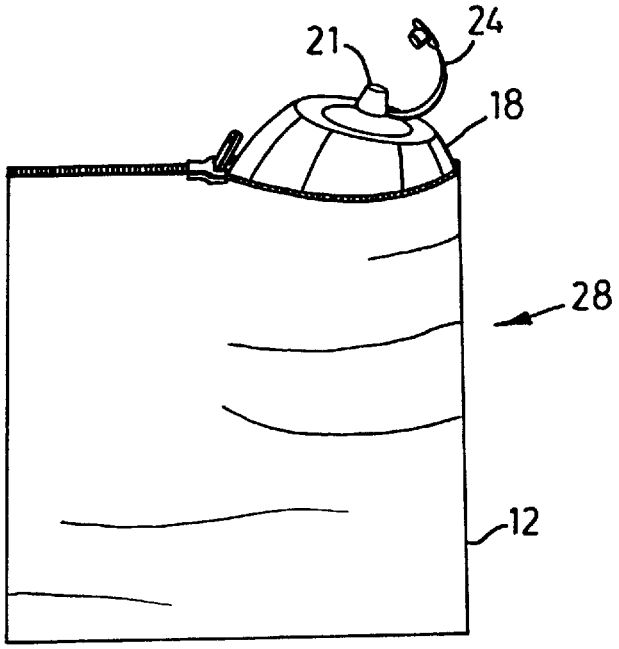
FIG. 3 illustrates the beach ball of FIG. 2 partially inserted into the pouch of FIG. 1.

The preferred method for inflating the beach ball can be understood from FIG. 3. First the ball 18 is placed in the pouch except for a small portion around the valve 21 which is allowed to protrude from the top side of the pouch. The zipper 15 is then partially closed. Next the ball is inflated by a desired amount, but the ball is at least sufficiently inflated so that it largely fills the pouch and sufficiently inflated so as to allow the pouch to be deformed into an arc suitable for back support. The valve 21 is then plugged, the remaining portion of the ball is stuffed into the partial opening and the zipper is closed all the way.

Figure 4:
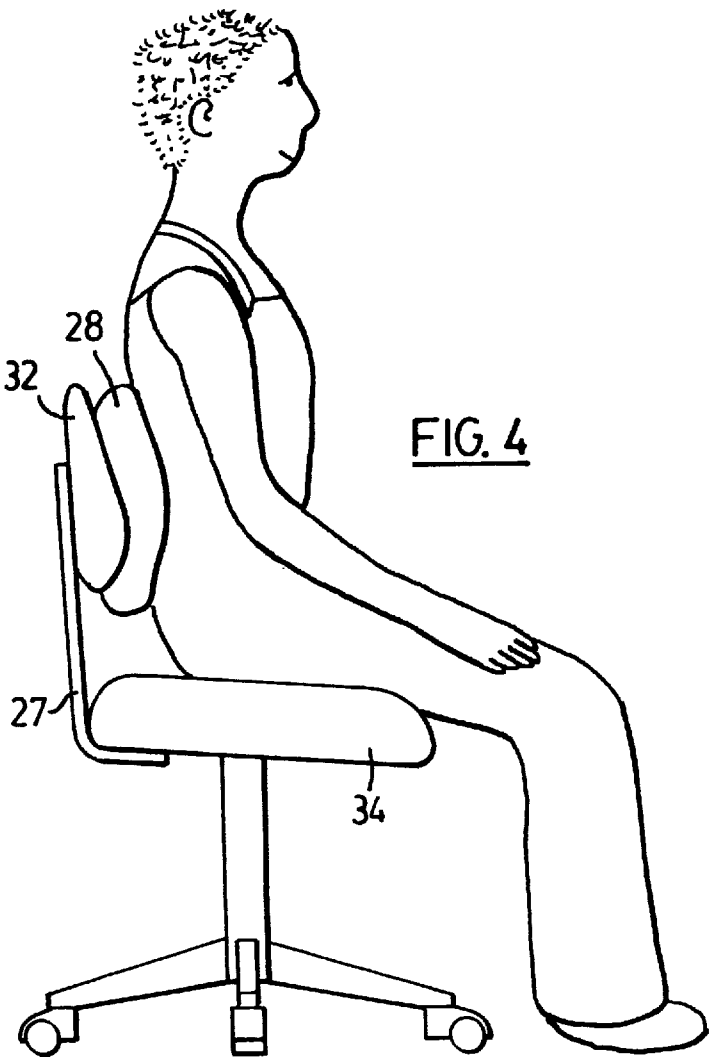
FIG. 4 is an elevational view of a person in a chair showing a preferred placement of the device for back support purposes.

FIG. 4 shows the back support device 28 of the present invention being used with an office swivel chair 27. The chair 27 has its own backrest 32 and a seat portion 34. In this preferred use of the sitting posture correction device, the device is placed adjacent the lower region of the backrest 32. The device is not maintained in place by a strap or other securing means as these are not required. Rather it is simply sandwiched between the backrest and the back of the user. It will be appreciated however that one could construct the portable device 28 with a strap or other securing device which would allow the device 28 to be secured at least loosely to the backrest 32. Straps and other connecting devices for back supports to secure them to chair backrests are well known in the prior art and therefore a detailed description herein is deemed unnecessary.

The shape of the device 28 will change as the user places more or less weight on the device. As more weight is placed on the device 28, the device will bloat out at the sides. Bloating at the sides is constrained to a certain extent by the dimensions of the pouch. Eventually the force created by the weight of the user will be balanced by a reactionary force from the device 28. The surface of the device 28 is deformed into an arc shape that serves to dynamically support the spine.

When the device 28 is placed in the position shown in FIG. 4, the lower back of the user is particularly supported. Use of the device as illustrated allows for a proper efficient relationship between a user's pelvis, chest and head to be preserved The head of the user sits on top of the spine, and the chest is in a more upright position than it would be otherwise.

Figure 5:
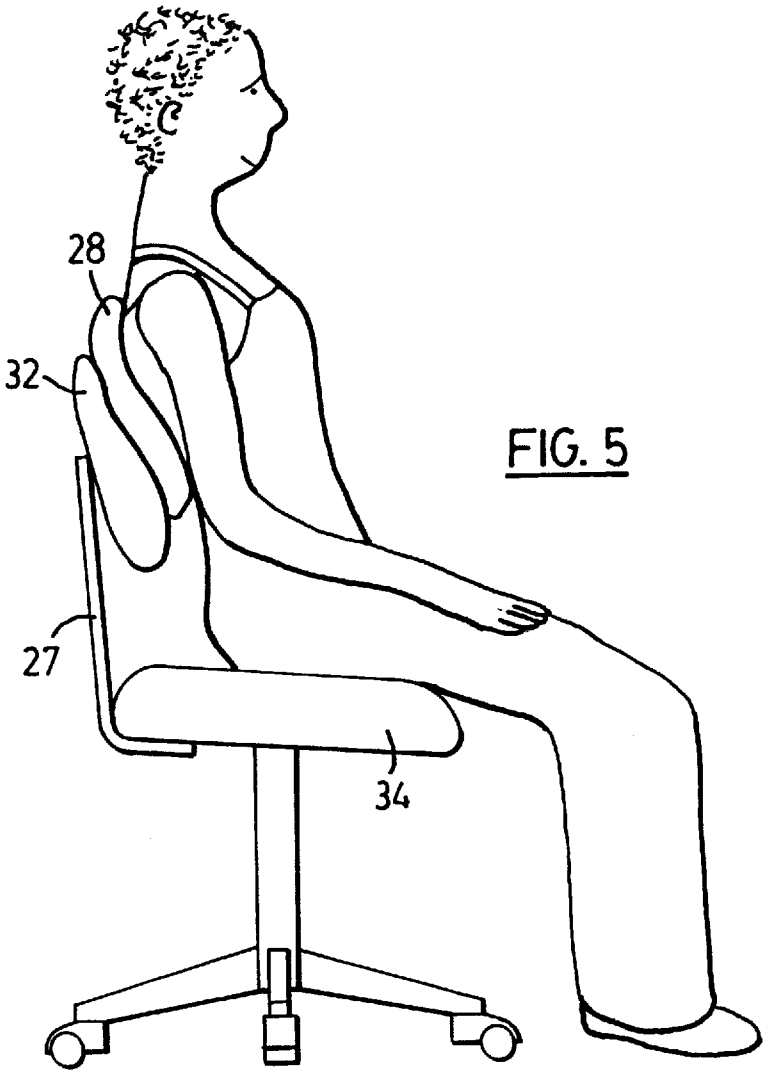
FIG. 5 is an elevational view of a person in a chair showing another preferred placement of the device for back support purposes.

FIG. 5 is an alternative position for the device 28 and is a higher position. The head of the user again sits on top of the spine. The chest of the user is supported and the normal low back curve is well maintained. Use of the device as shown in FIGS. 4 and 5 promotes efficient sitting postures and discourages poor body use. Although FIGS. 4 and 5 show the device being used with an office swivel chair, the device can be used with many types of seats. The device can be used with seats found in cars, at work, at home, in movie theaters, and at sporting events, just to name a few.

A beach ball need not be employed as the inflatable bladder for the present invention. A different type of inflatable bladder with dimensions comparable to the previously described beach ball can also achieve the desired results. One preferred form of bladder, while being still inexpensive to manufacture, would be made of a more durable material than that of the beach ball. For example, a thicker vinyl material would be preferred because the beach ball is made of thin vinyl material which could possibly rupture if the ball is not properly used or cared for. Any alternative inflatable bladder should however be free to shift within the pouch. The shifting allows support to be directed to appropriate parts of the body.

The present posture correcting device uses a simple design that helps to make the act of sitting a dynamic activity. Using the spherically shaped, partially inflated beach ball contained within the square shaped cover creates a dynamic body support. As the mass of the body leans against the posture correcting device the air within it pushes the body up, away from a collapsed, distorted shape. Once an individual learns a couple of different placements for the device they will begin to program their body to become more aware of when it is in a state of poor body use versus efficient body use.

As will be apparent to those skilled in the art in the light of the foregoing disclosure, alterations and modifications are possible in the practice of this invention without departing from the spirit or scope thereof. Accordingly, the scope of the invention is to be construed in accordance with the substance defined by the following claims.

What is claimed is:

1. A posture correcting device for placement between a backrest and the back of a user, the device comprising:

a inflatable bladder which is generally spherical in shape when fully inflated; and a flexible, substantially rectangular cover for said bladder forming a pocket and adapted to contain said bladder, when the latter is partially inflated in said pocket, said cover being substantially flat in an empty state when the cover does not contain the bladder and having a closable opening for insertion of or removal of said bladder, wherein, during use of the device, said opening is closed and the bladder is contained within the cover, is partially inflated, and is free to shift and change its shape within the cover.

2. The device of claim 1 wherein said cover is made from a canvas textile material.

3. The device of claim 1 wherein said inflatable bladder is a ball whose size and construction correspond to those of a standard sized beach ball.

4. The device according to claim 1 wherein said bladder is a vinyl bladder and is detached from said cover during use of said device.

5. The device according to claim 4 wherein said bladder includes a valve for inflating or deflating said bladder and has a diameter in excess of 12 inches when the bladder is fully inflated.

6. The device of claim 1 wherein the cover is formed with two sheets of cloth material stitched together along sheet edges, which are between 10 inches and 12 inches in length.

7. The device of claim 6 wherein the sheet edges form substantially a square.

8. A device for back support and posture correction comprising:

an inflatable bladder which is generally spherical in shape and has a diameter exceeding 12 inches when fully inflated; and a flexible pouch made of cloth material and adapted to contain said bladder when the bladder is only partially inflated, said pouch being substantially flat in an empty state when the pouch does not contain the bladder, said pouch including means for opening and closing an opening along one side edge of said pouch, wherein, when the device is employed. said opening is closed and said partially inflated bladder largely fills said pouch.

9. The device according to claim 8 wherein said means for opening and closing comprises a zipper.

10. The device of claim 8 wherein said inflatable bladder is a flexible ball whose size and construction correspond to those of a beach ball.

11. The device of claim 8 wherein said bladder is a vinyl bladder having a diameter of about 16 inches when fully inflated.

12. The device of claim 8 wherein said bladder includes a valve for inflating or deflating said bladder and said flexible pouch is substantially rectangular or square with a minimum length and width of at least 10 inches.

13. The device of claim 8 wherein the pouch is formed with two sheets of said cloth material attached together along sheet edges, which are between 9 inches and 13 inches in length.

14. The device of claim 13 wherein said bladder has an approximate diameter of 16 inches.

15. A posture correction device for placement between a backrest and the back of a user, the device comprising:

a single, partially inflated bladder which is substantially spherical in shape and has a width exceeding 12 inches when fully inflated; and a flexible cloth pouch containing said bladder which is removable from said pouch, said pouch having a closable opening for insertion of or removal of said bladder, said cloth pouch being substantially flat and rectangular in an empty state when said cloth pouch does not contain said bladder, wherein during use of the device, said bladder is free to shift and change its shape within the pouch.

16. The device of claim 15 wherein said pouch is made from a canvas textile material.

17. The device of claim 15 wherein said pouch further includes a zipper for opening and closing said opening in said pouch.

18. The device according to claim 16 wherein said inflatable bladder has a generally spherical shape and a diameter of about 16 inches.

19. The device of claim 15 wherein said bladder is a vinyl bladder.

* * * * *

UNITED STATES PATENT AND TRADEMARK OFFICE

CERTIFICATE OF CORRECTION

PATENT NO. : 6,496,994 B1 
DATED : December 24, 2002
INVENTOR(S) : Omel et al.

It is certified that error appears in the above-identified patent and that said Letters Patent is hereby corrected as shown below:

Column 1,
Line 46, after “flexible” insert -- , --.

Column 2,
Line 8, replace “invention” with -- invention. --.
Line 9, replace “shoots” with -- sheets --.
Line 10, replace “call” with -- can --.
Line 12, replace “art” with -- art. --.

Column 3,
Line 8, replace “preserved” with -- preserved. --.
Line 51, replace “a inflatable” with -- an inflatable --.
Line 55, replace “inflated in” with -- inflated, in --.

Column 4,
Line 24, replace “employed” with -- employed. --.

Signed and Sealed this

Fifteenth Day of April, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,496,994 B1
APPLICATION NO. : 09/613776
DATED : December 24, 2002
INVENTOR(S) : Omel et al.

It is certified that error appears in the above-identified patent and that said Letters Patent is hereby corrected as shown below:

Column 1,
Line 46, after "flexible" insert -- , --.

Column 2,
Line 8, replace "invention" with -- invention. --.
Line 9, replace "shoots" with -- sheets --.
Line 10, replace "call" with -- can --.
Line 12, replace "art" with -- art. --.

Column 3,
Line 8, replace "preserved" with -- preserved. --.
Line 51, replace "a inflatable" with -- an inflatable --.
Line 55, replace "inflated in" with -- inflated, in --.

Column 4,
Line 24, replace "employed." with -- employed, --.

This certificate supersedes Certificate of Correction issued April 15, 2003.

Signed and Sealed this

Fifth Day of June, 2007

JON W. DUDAS
*Director of the United States Patent and Trademark Office*